United States Patent [19]

Hashimoto

[11] Patent Number: 4,561,462

[45] Date of Patent: Dec. 31, 1985

[54] MULTIPLE CONTROL VALVE SYSTEM

[75] Inventor: Yutaka Hashimoto, Ayase, Japan

[73] Assignee: Toshiba Kikai Kabushiki Kaisha, Tokyo, Japan

[21] Appl. No.: 696,846

[22] Filed: Jan. 29, 1985

Related U.S. Application Data

[63] Continuation of Ser. No. 340,382, Jan. 18, 1982, abandoned.

[30] Foreign Application Priority Data

Jan. 19, 1981 [JP] Japan ..... 56-6071

[51] Int. Cl.[4] ..... F15B 13/08; F15B 13/09

[52] U.S. Cl. ..... 137/596.13; 91/6; 91/529; 137/596.15

[58] Field of Search ..... 91/6, 529; 137/596.12, 137/596.13, 596.15

[56] References Cited

U.S. PATENT DOCUMENTS 4,142,445 3/1979 Lohbauer ..... 91/6

4,210,061 7/1980 Bianchetta ..... 91/6

*Primary Examiner*—Gerald A. Michalsky

*Attorney, Agent, or Firm*—Koda and Androlia

[57] ABSTRACT

A multiple control valve system comprises the first and second multiple control valves. To the first multiple control valve an additional attachment valve is operatively connected in a manner that pressurized oil is supplied to the first multiple control valve and the attachment valve from a common oil pump independently through respective conduits. The second multiple control valve is connected to the attachment valve through a conduit to which a remote control valve is disposed thereby to change over flow direction changeover valves contained in the attachment valve and the second multiple control valve to simultaneously operate these valves.

1 Claim, 1 Drawing Figure

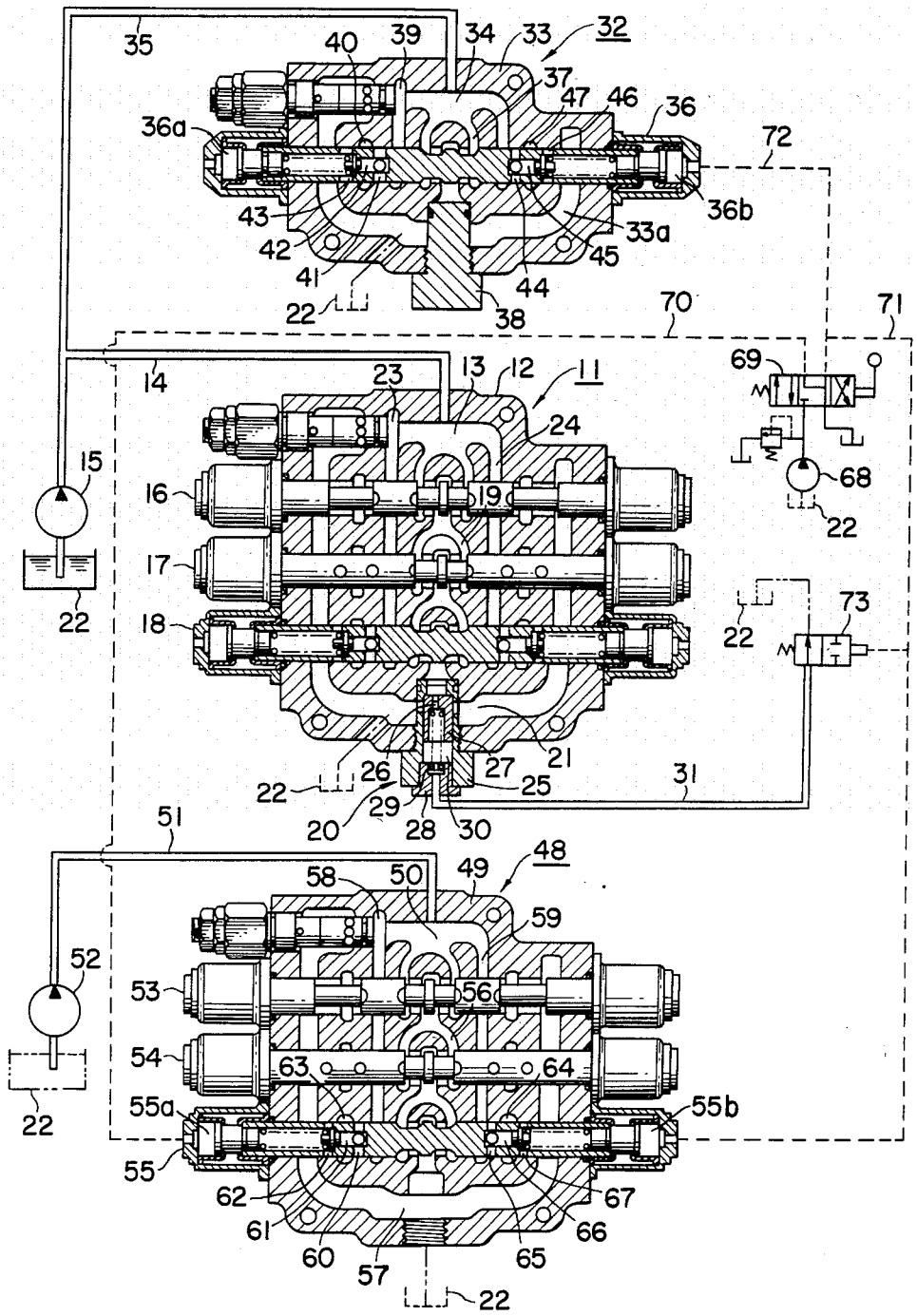
35
40
39
34
33
32
37
47
46
36
36a
72
36b
43
33a
42
45
41
44
22
38
70
71
14
23
13
12
11
69
24
15
16
19
68
22
17
22
73
18
21
26
27
22
25
31
29
20
28
30
51
58
50
49
48
59
52
53
56
54
63
64
55a
55b
22
55
62
67
61
66
60
65
57
22

MULTIPLE CONTROL VALVE SYSTEM

This is a continuation of application Ser. No. 340,382, filed Jan. 18, 1982, now abandoned.

BACKGROUND OF THE INVENTION

This invention relates to a multiple control valve system of a hydraulic circuit for operating a working machine.

There are many working machines each including a number of elements respectively actuated by piston-cylinder assemblies actuated by pressurized oil. For the sake of brevity, such piston-cylinder assembly is hereinafter merely called an actuator. In a working machine including a large number of actuators, some of them are operated by pressurized oil supplied by one oil pump, while the other actuators are operated by the pressurized oil supplied by another oil pump.

A hydraulic power shovel of a civil machine, which is one typical example of a large working machine, is controlled by first and second multiple control valves operatively connected to hydraulic pumps, in which the first multiple control valve controls actuators for a running (right or left), swivelling and arm mechanisms of the machine by the operation of three direction change-over valves disposed therein and the second multiple control valve controls actuators for a running (left or right) mechanism, a boom and a bucket of the power shovel. The first and second multiple control valves each including three direction change-over valves are attached to a mount disposed at a limited place in the power shovel.

In one specific use of the multiple control valve system of the type described above to increase operating flow amount of pressurized oil in a bucket of a power shovel, a multiple control valve including four-series direction change-over valve means is used as a first multiple control valve instead of the first multiple control valve having three-series direction change-over valve described above without changing the second multiple control valve in a manner that one of the four-series direction change-over valves is connected to a bucket actuating circuit of the second multiple control valve to join flows of pressurized oil which passes through the first and second multiple control valves. However, it is considerably difficult to set or attach a multiple control valve including four direction change-over valves to a mount attached at a limited place of the power shovel instead of an existing multiple control valve including three direction change-over valves. Moreover, even if these multiple control valves could be exchanged by newly adding a mount member, much time and many steps are required for attaching or detaching these heavy multiple control valves and conduits or other members which are to be connected to the multiple control valve exchanged.

SUMMARY OF THE INVENTION

An object of this invention is to provide an improved multiple control valve system capable of obviating defects encountered by a known type system.

Another object of this invention is to provide a multiple control valve system in which an additional valve is operatively connected to a first multiple control valve which is operatively connected to a second multiple control valve through a remote control valve so as to join pressurized oil flows from a first and second oil pumps thereby to increase operative flow amount of the pressurized oil acting to an actuator of a working machine.

According to this invention there is provided a multiple control valve system characterized by comprising: a first multiple control valve having an oil inlet chamber connected to an external first pressurized oil pump, oil passages connected to the oil chamber, and a plurality of change-over valves for changing over flow direction of the pressurized oil passing through the oil passages; a second multiple control valve having an oil inlet chamber connected to an external second pressurized oil pump, oil passages connected to the oil chamber, and a plurality of change-over valves for changing over flow direction of the pressurized oil passing through the oil passages, at least one of the change-over valves being provided with pilot chambers at its both ends; an additional attachment valve having an oil inlet chamber connected to the first pressurized oil pump, oil passages connected to the oil inlet chamber, and a change-over valve for changing-over flow direction of the pressurized oil passing through the oil passages, the change-over valve being provided with pilot chambers at its both ends; a logic valve oil-tightly fitted to the first multiple control valve so as to be communicated with the oil passages formed in the first multiple control valve and provided with a pilot chamber connected to an external oil tank through a conduit; and a remote control valve operatively connected to one pilot chamber of the change-over valve of the attachment valve, one pilot chamber of one of the change-over valves of the second multiple control valve, and the other pilot chamber of the change-over valve of the second multiple control valve through conduits, respectively, and also connected to an external pilot pump, thereby to simultaneously operate the change-over valves of the second multiple control valve and the attachment valve.

The multiple control valve system according to this invention can further comprise a selector valve disposed to the conduit connecting the pilot chamber of the logic valve and the oil tank, and the selector valve is operatively connected to the conduit connecting the pilot chamber of the change-over valve of the attachment valve and one pilot chamber of the change-over valve of the second multiple control valve.

BRIEF DESCRIPTION OF THE DRAWING

The accompanying single drawing shows a longitudinal cross section of one embodiment of a multiple control valve system according to this invention.

DESCRIPTION OF THE PREFERRED EMBODIMENT

One preferred embodiment of a multiple control valve system according to this invention will be described hereinbelow in conjunction with the accompanying drawing, in which reference numeral 11 designates a first multiple control valve and a valve body 12 of the first valve 11 is provided with an oil inlet chamber 13 into which pressurized oil is supplied from a first oil pump 15 through a conduit 14. When oil flow direction change-over valves 16 through 18, usually called spools, contained in the first multiple control valve 11 occupy their neutral positions, the pressurized oil flows into a tank 22 under unloaded condition through a bypass passage 19, a logic valve 20, and a return passage 21. The pressurized oil is supplied to the change-over valves 16 through 18 in contact with side passages 23 and 24 which are connected to the inlet chamber 13.

The logic valve 20 has a hollow valve body 25 oil-tightly fitted into the lower portion, as viewed in the drawing, of the valve body 12 and a spool 27 of the logic valve 20 provided with a hole at its front end is inserted into the hollow valve body 25. The spool 27 is always urged upwardly by a spring 29 having one end engaging a plug 28 fitted into the hollow valve body 25 of the logic valve 20 and a pilot chamber 30 formed between the lower surface of the spool 27 and the plug 28 is connected to a conduit 31.

Reference numeral 32 designates a valve attached or operatively connected to the first multiple control valve 11, the valve 32 being called hereinafter merely an attachment valve 32. A valve body 33 of the attachment valve 32 is provided with an oil inlet chamber 34 which is connected to the first oil pump 15 through a conduit 35. When an oil flow direction change-over valve 36 of the attachment valve 32 is positioned at its neutral position, the pressurized oil is introduced into a by-pass passage 37 connected to the inlet chamber 34, but the flow of the pressurized oil towards the tank 22 is checked by a plug 38 located between the by-pass passage 37 and a return passage 33*a*. When the change-over valve 36 is moved leftwardly, as viewed in the drawing, the pressurized oil in the chamber 34 flows into one hydraulic chamber of an actuator of a bucket, not shown, through holes 44 through 46 and a cylinder port 47, and the pressurized oil in the other hydraulic chamber of the actuator is discharged into the tank 22 through a cylinder port 40, holes 41 through 43, and a return passage 33*a*. Pilot chambers 36*a* and 36*b* are formed on both sides of the change-over valve 36 of the attachment valve 32.

Reference numeral 48 designates a second multiple control valve and a valve body 49 of the second multiple control valve 48 is provided with an oil inlet chamber 50 into which the pressurized oil is supplied from a second oil pump 52 through a conduit 51. When oil flow direction change-over valves 53 through 55, usually called spools, contained in the second multiple control valve 48 are positioned at their neutral positions, the pressurized oil flows under unloaded condition towards the tank 22 through a by-pass passage 56 and a return passage 57. When one of these change-over valves, for example the valve 55, is moved leftwardly, the pressurized oil in the chamber 50 is supplied into one hydraulic chamber of an actuator of a bucket, not shown, through a side passage 59, holes 65 through 67, and a cylinder port 64. The pressurized oil in the other hydraulic chamber in the actuator is discharged into the tank 22 through a cylinder port 63, holes 60 through 62, and a return passage 57. Pilot chambers 55*a* and 55*b* are formed on both sides of the change-over valve 55.

In the drawing, the reference numerals 68 and 69 designate a pilot pump and a remote control valve, respectively, and the pressurized oil in the pilot pump 68 is selectively guided into the pilot chamber 55*a* or 55*b* of the second multiple control valve 48 through a conduit 70 or 71 by switching the remote control valve 69. A conduit 72 branched from the conduit 71 is connected to the pilot chamber 36*b* of the attachment valve 32. A selector valve 73 disposed to the conduit 31 is connected to the logic valve 20 in the drawing, but when a pressure is applied on the conduit 71, the selector valve 73 moves rightwardly to switch off the connection between the conduit 31 and the tank 22.

The multiple control valve system according to this invention operates as follows.

When the change-over valves 16 through 18 of the first multiple control valve 11 and the change-over valve 36 of the attachment valve 32 occupy their neutral positions now shown in the drawing, the pressurized oil from the first oil pump 15 flows into the oil inlet chamber 34 of the attachment valve 32 through the conduit 35 and the oil also flows into the oil inlet chamber 13 and then the by-pass passage 19 of the first multiple control valve 11 through the conduit 14. At this time, the pressurized oil is discharged into the tank 22 because the pilot chamber 30 of the logic valve 20 is connected through the selector valve 72 in a manner that the spool 27 of the logic valve 20 is lowered against the spring force by the pressure applied on the upper surface of the spool 27 thereby to cause the by-pass passage 19 communicate with the return passage 21.

When the change-over valves 53 through 55 of the second multiple control valve 48 are at their neutral positions now shown in the drawing, the pressurized oil from the second oil pump 52 flows into the oil inlet chamber 50 through the conduit 51 and is then discharged into the tank 22 through the by-pass passage 56 and the return passage 57.

When the remote control valve 69 is shifted rightwardly from a position now shown in the drawing while maintaining all change-over valves of the first and second multiple control valves 11, 48 and the attachment valve 32 at their neutral positions, the pressurized oil from the pump 68 is supplied into the pilot chamber 55*b* through the conduit 71 and the change-over valve 55 of the second multiple control valve 48 is then moved leftwardly by the pressure of the pressurized oil introduced into the pilot chamber 55*b*, whereby the by-pass passage 56 is closed and the pressurized oil from the second oil pump 52 is supplied into one hydraulic chamber of the actuator of a bucket disposed in a working machine through the side passage 59, the holes 65 through 67, and the cylinder port 67. The pressurized oil in the other hydraulic chamber of the actuator is discharged into the tank 22 through the cylinder port 63, the holes 60 through 62, and the return passage 57.

At the same time, the pressurized oil in the conduit 71 acts on the selector valve 73 to switch the same from the position now shown in the drawing to the righthand position thereby to shut off the supply of the pressurized oil from the pilot chamber 30 of the logic valve 20 to the tank 22 and the downstream side of the by-pass passage 19 is also closed thereby to increase the pressure of drain oil from the first pump 15.

The pressurized oil in the conduit 72 acts to the pilot chamber 36*b* of the attachment valve 32 to leftwardly shift the change-over valve 36 from the neutral position. Thus, the pressurized oil from the first oil pump 15 joins into one hydraulic chamber of the actuator of the bucket described above through the inlet chamber 34, the holes 44 through 46, and the cylinder port 47, and the pressurized oil in the other hydraulic chamber of the actuator is discharged into the tank 22 through the cylinder port 40, the holes 41 through 43, and the return passage 33*a*.

With the embodiment of this invention described hereinbefore, there is shown an example in which the change-over valves 55 and 36 are only shifted leftwardly as viewed in the drawing thereby to actuate one hydraulic chamber of the actuator of the bucket. However, it would be understood by those skilled in the art that in another preferred example, the change-over valves 55 and 36 can be shifted rightwardly as well as leftwardly by connecting the conduit 70 to the pilot chamber 36*a* of the attachment valve 32 and attaching a shuttle valve between the conduits 70 and 71 so that the selector valve 73 is controlled by a signal from the shuttle valve. Moreover, it is possible to form pilot chambers on both sides of the change-over valves 53 and 54 of the second multiple control valve 48, the pilot chambers being connected to the conduits 70 and 71, respectively.

In summary, the multiple control valve system according to this invention is provided with a remote control valve and an attachment valve operatively connected to a first multiple control valve in a manner that conduits connecting a first oil pump as an oil source and oil inlet chambers of the attachment valve and the first multiple control valve are arranged parallelly. The attachment valve is also connected to a second multiple control valve through a pilot conduit and oil flow direction change-over valves of the attachment valve and the second multiple control valve are simultaneously operated by pressurized oil passing through the pilot conduit which is controlled by a remote control valve located on a branch circuit from the pilot conduit. Thus, the pressurized oils from the first and second multiple control valves can be joined so as to flow into a hydraulic chamber of an actuator thereby to operate the same.

The multiple control valve system of this invention can utilize valve bodies of usual multiple control valves as constructional elements without newly manufacturing the valves and using additional conduits or pipes which may change the original structure, whereby the multiple control valve system can be economically manufactured and the manufacturing steps can be reduced. Moreover, it is not necessary to change the arrangement of a mount member in a working machine to which the multiple control valve system of the type of this invention is to be attached.

What is claimed is:

1. A multiple control valve system comprising:

a first multiple control valve having an oil inlet chamber connected to an external first pressurized oil pump through a first conduit, oil passages connected to said oil chamber, and a plurality of change-over valves for changing over flow direction of the pressurized oil passing through said oil passages;

a second multiple control valve having an oil inlet chamber connected to an external second pressurized oil pump, oil passages connected to said oil chamber, and a plurality of change-over valves for changing over flow direction of the pressurized oil passing through said oil passages, at least one of said change-over valves being provided with pilot chambers at its both ends;

an additional attachment valve having an oil inlet chamber which is always operatively connected to said first pressurized oil pump through a second conduit in parallel with said first conduit regardless of the shifting of any one of said change-over valves of said first multiple control valve, oil passages connected to said oil inlet chamber, a by-pass passage closed by plugging means, and a change-over valve for changing-over flow direction of the pressurized oil passing through said oil passages, said change-over valve being provided with pilot chambers at its both ends;

a logic valve oil-tightly fitted to said first multiple control valve so as to be communicated with said oil passages formed in said first multiple control valve and provided with a pilot chamber connected to an external oil tank through a conduit;

a remote control valve operatively connected to one pilot chamber of the change-over valve of said attachment valve, one pilot chamber of one of said change-over valves of said second multiple control valve, and the other pilot chamber of the change-over valve of said second multiple control valve through conduits, respectively, and also connected to an external pilot pump, thereby to simultaneously operate the change-over valves of said second multiple control valve and said attachment valve; and a selector valve disposed to said conduit connecting said pilot chamber of said logic valve and said oil tank, said selector valve being operatively connected to the conduit connecting said pilot chamber of said change-over valve of said attachment valve and said one pilot chamber of said change-over valve of said second multiple control valve.

* * * * *